United States Patent [19]

Smathers

[11] Patent Number: 4,669,205

[45] Date of Patent: Jun. 2, 1987

[54] SEGMENTED SNOW PLOW APPARATUS

[76] Inventor: James A. Smathers, 133 S. 4th St., Douglas, Wyo. 82633

[21] Appl. No.: 822,265

[22] Filed: Jan. 24, 1986

[51] Int. Cl.[4] ..... E01H 5/04

[52] U.S. Cl. ..... 37/232; 172/711; 172/816

[58] Field of Search ..... 37/232, 233; 172/705, 172/706, 711, 816, 794

[56] References Cited

U.S. PATENT DOCUMENTS

| | | | |
|---|---|---|---|
| 338,262 | 3/1886 | Gibson | 37/231 |
| 438,081 | 9/1892 | Palmer | 172/794 |
| 520,479 | 5/1894 | Bunnell | 37/231 |
| 1,383,409 | 7/1921 | Liddell | 37/231 |
| 2,116,351 | 5/1938 | Jones et al. | 37/231 |
| 2,825,985 | 3/1958 | Weens | 172/816 |
| 2,962,821 | 12/1960 | Peitl | 37/231 |

FOREIGN PATENT DOCUMENTS

| | | | |
|---|---|---|---|
| 2221981 | 4/1974 | Fed. Rep. of Germany | 37/232 |
| 2329627 | 1/1975 | Fed. Rep. of Germany | 37/232 |
| 1050311 | 1/1954 | France | 37/232 |
| 416708 | 1/1967 | Switzerland | 37/232 |

*Primary Examiner*—E. H. Eickholt
*Attorney, Agent, or Firm*—Dean P. Edmundson

[57] ABSTRACT

Snow plow apparatus is described having segmented blade means comprising a plurality of bits. Each bit is connected to a vertically disposed shank having a triangular cross-section. The shank is slidably mounted in triangularly-shaped retention means carried by the plow moldboard. Bias means urges the shank and bit to its normal downward position. Each bit is independently mounted so that it can be vertically displaced when it encounters a high point in the roadway or an obstruction. The bias means urges the bit downwardly again when the obstruction is cleared.

15 Claims, 4 Drawing Figures

FIG. 3
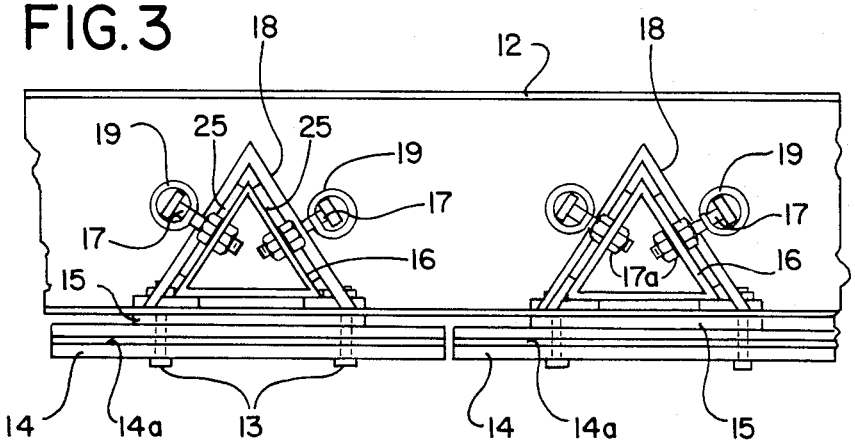
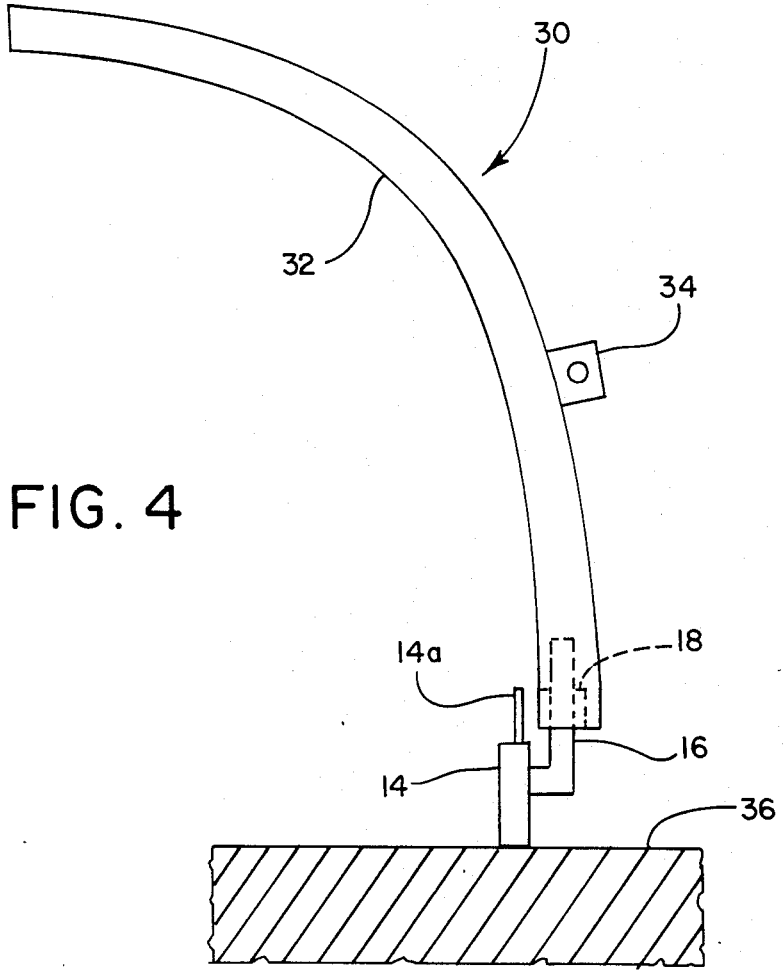
FIG. 4

SEGMENTED SNOW PLOW APPARATUS

FIELD OF THE INVENTION

This invention relates to snow plow apparatus. More particularly, this invention relates to apparatus which can be attached to trucks, etc. for plowing snow off roadways.

Background of the Invention

Conventional snow plows typically utilize a unitary blade concept, i.e., a single moldboard having a single rigid blade attached to its lower edge. Such a snow plow concept is adequate for operation on a smooth, flat road surface which is free of obstructions, but the average road surface is not smooth or flat nor is it always free of obstructions.

For example, road surfaces typically have portions which have a greater height than other portions (e.g., the center or mid-portion of the road is usually higher than the edges). Also, obstructions along a road surface are very common (e.g., where there has been damage to the road surface, or where the road has buckled for any reason, or where a lip or ridge exists along the edge of the road).

In such cases a conventional snow plow must be raised so as to clear the obstructions, thus leaving other portions of the roadway untouched. If the snow plow is not raised it will strike the obstructions, with possible damage to the snow plow, the roadway, or both.

Segmented scrapers and snow plows of various types have been previously proposed. For example, U.S. Pat. No. 520,479 describes a road scraper having blade sections attached to a flexible strip of rubber so that the blade sections can yield and bow to conform with the road surface. U.S. Pat. No. 1,383,409 describes a snow plow having blade sections which are pivotably mounted to the moldboard. When an obstruction is encountered the blade sections pivot rearwardly against a spring. Swiss Patent No. 416,708 describes a snow plow utilizing a similar concept. U.S. Pat. No. 338,262 describes a street scraper and snow plow having a series of overlapping sections which can be raised or lowered to conform to the road surface. U.S. Pat. No. 2,962,821 describes a snow plow in which blade sections can be forced rearwardly along an inclined path. A spring urges each blade section forwardly. U.S. Pat. No. 2,116,351 and French Patent No. 1,050,311 describe similar concepts.

None of such prior patents, however, describe snow plow apparatus which has been entirely satisfactory for all situations.

SUMMARY OF THE PRESENT INVENTION

In accordance with the present invention there is provided snow plow apparatus having a moldboard and blade means extending horizontally along the bottom edge of the moldboard. The blade means is segmented and comprises a plurality of bits which are independently mounted. Each bit has a horizontal lower edge, and each bit is connected to a vertically disposed shank having a triangular cross-section. Each shank is slidably mounted in triangularly-shaped retention means carried by the moldboard. Bias means (e.g., a spring) urges each bit to its normally downward position.

The snow plow apparatus of this invention is particularly useful and desirable since the segmented blade conforms to the surface of the roadway. That is, high points in the roadway urge the corresponding bit segments upwardly against the force of the bias means. Similarly, when any bit segment encounters an obstruction in the roadway, that bit segment moves upwardly (perpendicular to the roadway) against the force of the bias means until the obstruction is cleared. Then the bit segment moves downwardly again. This avoids expensive damage to the snow plow and the roadway.

BRIEF DESCRIPTION OF THE DRAWINGS

The invention is described in more detail hereinafter with reference to the accompanying drawings, wherein like reference characters refer to the same parts throughout the several views and in which:

FIG. 3 is a top view of the embodiment of segmented snow plow apparatus shown in FIG. 2; and FIG. 4 is a side elevational view of another embodiment of snow plow apparatus of the invention.

DETAILED DESCRIPTION OF THE INVENTION

Figure 1:
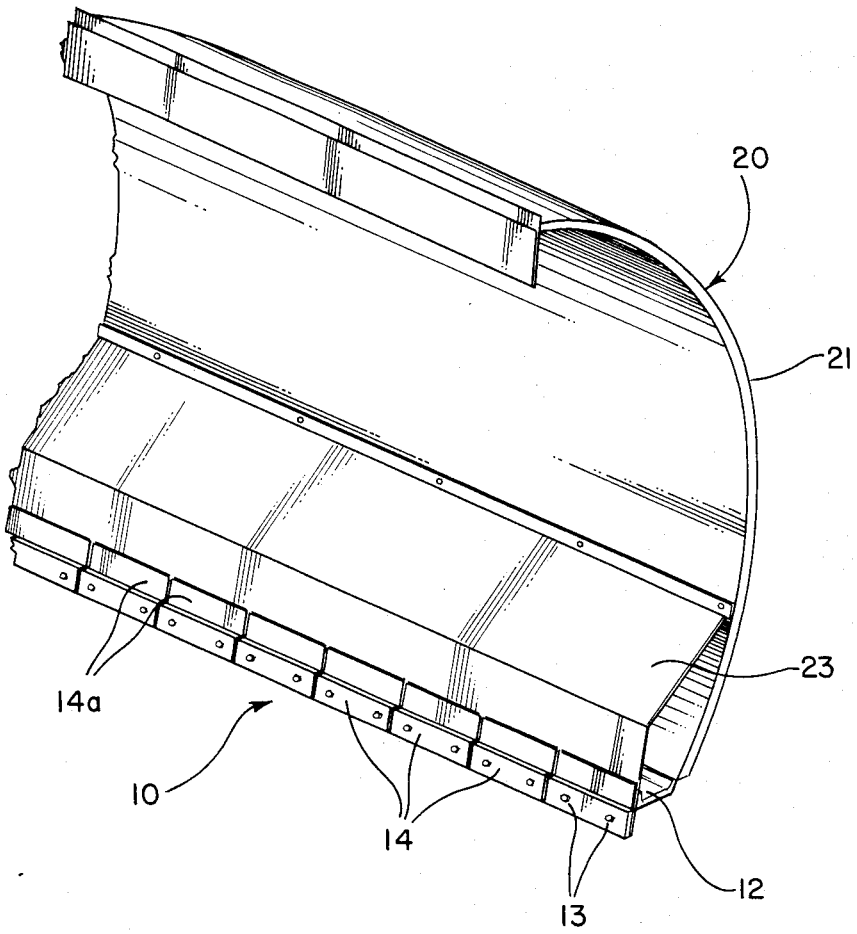
FIG. 1 is an isometric view of one embodiment of segmented snow plow apparatus of the invention.

In FIG. 1 there is illustrated one embodiment of the invention comprising attachment apparatus 10 which is shown attached to the front lower edge of the moldboard of conventional snow plow 20. The attachment apparatus comprises elongated channel or frame member 12 which extends along, and is secured to, the lower edge of the moldboard. It may be secured, for example, by means of bolts.

A plurality of bits 14 are aligned end-to-end along the lower edge. Each bit has a horizontal lower edge, and each bit is adapted to move vertically (i.e., perpendicularly) with respect to the roadway, as described in more detail hereafter. Each bit is adapted to be displaced vertically independently of the other bits.

Figure 2:
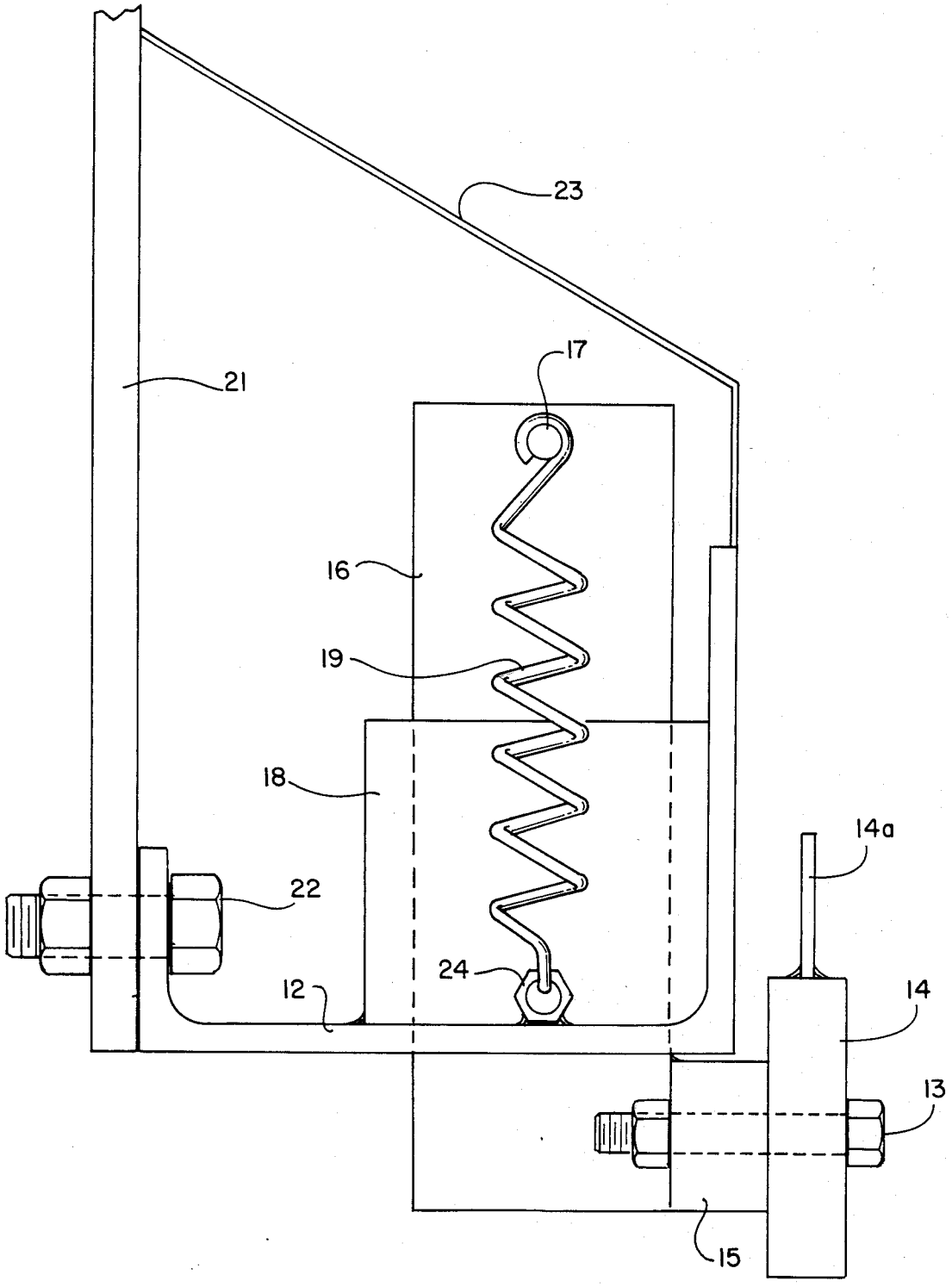
FIG. 2 is a side elevational view of one embodiment of segmented snow plow apparatus of the invention.

In FIG. 2 there is shown a side elevational view of the apparatus 10 attached to a conventional moldboard 21 of snow plow 20 by means of a plurality of bolts 22, each of which passes through registering apertures in moldboard 21 and frame member 12. Fender 23 extends upwardly and rearwardly from the front of frame member 12 to moldboard 21.

A vertically disposed shank 16 (which is perpendicular to the roadway) is attached to the backside of each bit by means of hanger member 15 and bolt 13. Each shank 16 has a triangular cross-section, and each shank extends upwardly through an opening in frame 12. Retention means or guide means 18 also has a triangular cross-section. Shank 16 extends upwardly through retention means 18 (as illustrated in FIGS. 2 and 3). Shank 16 is adapted to slide vertically with respect to retention or guide means 18. Preferably there is at least about 0.015 inch spacing between the outer surfaces of the shank and the inner surfaces of the retention or guide means.

Bias means 19 (for example, a spring) urges shank 16 and bit 14 to its normally downward position. The upper end of bias means 19 is connected to pin or bolt 17 carried by shank 16, and the lower end of bias means 19 is attached to retainer 24 carried by frame 12.

In FIG. 2 the shank 16 and bit 14 are shown in raised position, such as would be the case when bit 14 encounters an obstacle or obstruction in the roadway or when the surface of the roadway is uneven. After the bit 14 clears any such obstruction the bit and shank are urged to the normal downward position again by bias means 19.

Fender 23 prevents snow from falling onto the top of the frame and the shanks 16. The small deflector 14*a* fastened to the top of bit 14 prevents snow from getting under frame 12 when bit 14 is in its normal downward position.

FIG. 3 is a top view of a portion of the embodiment of apparatus shown in FIG. 2. This view illustrates the triangular cross-section of the shank 16 and also the retention or guide means 18. Pins or bolts 17 are secured at their inner ends to the upper portion of shanks 16 (e.g., by means of nuts 17*a*). The outer ends of pins or bolts 17 extend past retention means 18. The upper end of each spring 19 is attached to a respective pin or bolt 17. Optionally, there may be included wear plates 25 between shank 16 and retention means 18. Bolts or pins 17 prevent shank 16 from sliding completely out of the retention means 18.

FIG. 4 is a side elevational view of another embodiment of the invention. In this figure there is shown snow plow apparatus 30 comprising moldboard 32 and bits 14 slidably mounted along the bottom edge of moldboard 32. Each bit 14 has a horizontally disposed lower edge, and each bit 14 is connected to a vertically disposed shank having a triangular cross-section. Each shank is slidably mounted in triangularly-shaped retention or guide means 18 carried by the back side of the moldboard. Bracket 34 secured to the back side of the moldboard serves as an attachment means for connection of the snow plow apparatus to a truck or other vehicle for operating the apparatus along roadway 36.

Thus, the invention provides novel snow plow apparatus which may be an integral unit (such as is illustrated in FIG. 4) or it may be in the form of an attachment which may be attached to a conventional snow plow (such as is illustrated in FIG. 1). The apparatus may be made in any desired length. The attachment apparatus as illustrated in FIG. 1 may be made in commonly used length such as 3, 4, 5 or 6 feet so that an existing snow plow of virtually any length may be fitted with a selected combination of attachment units so that the full length of the snow plow is modified in accordance with this invention.

The length of each bit segment is typically in the range of about 6 to 12 inches. The extent of permissible vertical displacement for each shank and bit is typically in the range of about 2 to 3 inches, although more displacement may be used, if desired. It is very important, however, for the shank and bit to be displaceable only in the vertical direction (i.e., perpendicular to the roadway) in order for the apparatus to work properly.

Preferably each bit is rectangular, as shown in the drawings. It is also preferable for the bits to have a flat, smooth front surface. The thickness of the bits may vary, although it is preferred that they be about 0.75 to 1.5 inch in thickness. The life of the bits is enhanced if they are made of carbide or some other wear-resistant material such as urethane (DuraSteel).

The shanks to which the bits are attached must have a triangular cross-section. It has been found that this is the only configuration which works satisfactorily in this invention. Although shanks of other cross-sectional configurations have been tried (e.g., circular, rectangular, fluted, etc.), such configurations invariably result in binding between the shank and the other retention or guide means. It is significant that only the triangular cross-section operates in the apparatus of this invention without binding during operation, regardless of the orientation of the snow plow to the direction of travel along the roadway.

The wear plates 25 shown in FIG. 3 between the shank 16 and the retention means 18 are secured to the inner surface of retention means 18. There is inevitably some wearing when shank 16 slides up and down in retention means 18. When the surface of the wear plates becomes worn to such an extent that it is necessary to replace them, it is only necessary to unbolt the plates and replace them with new wear plates. Lubrication may be used on the shank, if desired, to reduce wearing between the shank and the plates during operation.

Other variants are possible without departing from the scope of this invention.

What is claimed is:

1. Snow plow apparatus comprising a moldboard and blade means extending horizontally along the bottom edge of said moldboard, wherein said blade means is segmented and comprises a plurality of bits, each of said bits having a horizontally disposed lower edge, each said bit being connected to a vertically disposed shank having a triangular cross-section, wherein said shank is slidably mounted in triangularly-shaped retention means carried by said moldboard, wherein bias means urges each said bit to a normally downward position, and wherein each said bit is adapted to be independently displaced vertically from its normal downward position to a temporary raised position against the force of said bias means when said bit encounters an obstruction in the roadway during use.

2. Snow plow apparatus in accordance with claim 1, wherein each said bit is rectangular, and wherein the face of each said bit is planar.

3. Snow plow apparatus in accordance with claim 1, wherein said retention means comprises a horizontal frame secured to said moldboard.

4. Snow plow apparatus in accordance with claim 1, wherein said bias means comprises a spring connected between said shank and said retention means.

5. Snow plow apparatus in accordance with claim 1, wherein said retention means includes wear plates against which each said shank is adapted to slide vertically.

6. Snow plow apparatus in accordance with claim 1, wherein each said bit has a length in the range of about 6 to 12 inches.

7. Snow plow apparatus in accordance with claim 1, wherein each said bit is adapted to be vertically displaced a distance in the range of about 2 to 3 inches.

8. Segmented snow plow attachment apparatus which is adapted to be attached to the lower edge of the moldboard of a snow plow, said attachment apparatus comprising:

(a) an elongated frame member;

(b) retention means carried by said frame member, said retention means being triangularly-shaped;

(c) a plurality of bits, each of which has a horizontally disposed lower edge, (d) a vertically disposed shank secured to each said bit, said shank having a triangular cross-section, wherein each said shank is independently mounted in said retention means and is adapted to slide vertically within said retention means from a normal downward position to a raised position;

(e) bias means carried by said frame member, said bias means being adapted to urge each said shank to its said normal downward position.

9. Segmented snow plow attachment apparatus in accordance with claim 8, wherein said frame member is adapted to be secured to said lower edge of said moldboard.

10. Segmented snow plow attachment apparatus in accordance with claim 8, further comprising fender means extending along the length of said frame, said fender means having upper and lower edges, wherein said lower edge of said fender means is attached to said frame member, and wherein said upper edge of said fender means is adapted to be attached to said moldboard.

11. Segmented snow plow attachment apparatus in accordance with claim 10, wherein each said bit has a length in the range of about 6 to 12 inches.

12. Segmented snow plow attachment apparatus in accordance with claim 10, wherein said retention means includes wear plates against which each said shank is adapted to slide vertically.

13. Segmented snow plow attachment apparatus in accordance with claim 10, wherein said bias means comprises a spring connected between said shank and said retention means.

14. Segmented snow plow attachment apparatus in accordance with claim 10, wherein each said bit is rectangular, and wherein the face of each said bit is planar.

15. Segmented snow plow attachment apparatus in accordance with claim 8, wherein each said bit is adapted to be vertically displaced a distance in the range of about 2 to 3 inches.

* * * * *